United States Patent [19]

Bose

[11] 4,428,828

[45] Jan. 31, 1984

[54] UPGRADING HYDROCARBONACEOUS OILS WITH AN AQUEOUS LIQUID

[75] Inventor: Phillip R. Bose, Pleasant Hill, Calif.

[73] Assignee: Chevron Research Company, San Francisco, Calif.

[21] Appl. No.: 324,217

[22] Filed: Nov. 25, 1981

Related U.S. Application Data

[63] Continuation-in-part of Ser. No. 222,231, Jan. 2, 1981, abandoned.

[51] Int. Cl.[3] ..... C10G 19/02; C10G 21/08

[52] U.S. Cl. ..... 208/208 R; 208/130; 208/203; 208/230; 208/251 R; 208/254 R; 208/283; 208/284

[58] Field of Search ..... 208/283, 226, 3, 7, 208/208 R, 251 R, 254 R, 130, 203, 230

[56] References Cited

U.S. PATENT DOCUMENTS

| | | | |
|---|---|---|---|
| 2,402,799 | 6/1946 | Arnold et al. | 208/208 R |
| 2,729,591 | 1/1956 | Haresnape et al. | 208/203 X |
| 3,151,083 | 9/1964 | Shellard et al. | 208/3 |
| 3,725,250 | 4/1973 | Wilson et al. | 208/208 R |
| 3,761,398 | 9/1973 | Munekata et al. | 208/208 R |
| 3,824,084 | 7/1974 | Dillon et al. | 201/17 |
| 3,876,497 | 4/1975 | Hoffman | 210/761 |
| 3,912,626 | 10/1975 | Ely et al. | 210/724 |
| 3,960,708 | 6/1976 | McCollum et al. | 208/251 R |
| 3,989,618 | 11/1976 | McCollum et al. | 208/208 R |
| 4,013,560 | 3/1977 | Pradt | 210/761 |
| 4,100,730 | 7/1978 | Pradt | 210/761 |
| 4,174,280 | 11/1979 | Pradt et al. | 210/761 |
| 4,174,953 | 11/1979 | Sun et al. | 201/17 |
| 4,197,090 | 4/1980 | Yoo et al. | 201/17 |
| 4,203,830 | 5/1980 | Rollmann et al. | 208/251 R |
| 4,211,174 | 7/1980 | Martin et al. | 210/761 |
| 4,370,223 | 1/1983 | Bose | 208/125 |

OTHER PUBLICATIONS

Mechanical Eng., Dec. 1979, pp. 30–37.

AICHE Symposium Series, vol. 76, No. 192, p. 51.

*Primary Examiner*—Delbert E. Gantz

*Assistant Examiner*—O. Chaudhuri

*Attorney, Agent, or Firm*—D. A. Newell; S. R. La Paglia; A. H. Uzzell

[57] ABSTRACT

A process for upgrading oils is disclosed, in which the oil to be upgraded is contacted with liquid phase water and free oxygen at an elevated temperature and at a pressure sufficient to maintain at least part of the water in the liquid phase.

14 Claims, 1 Drawing Figure

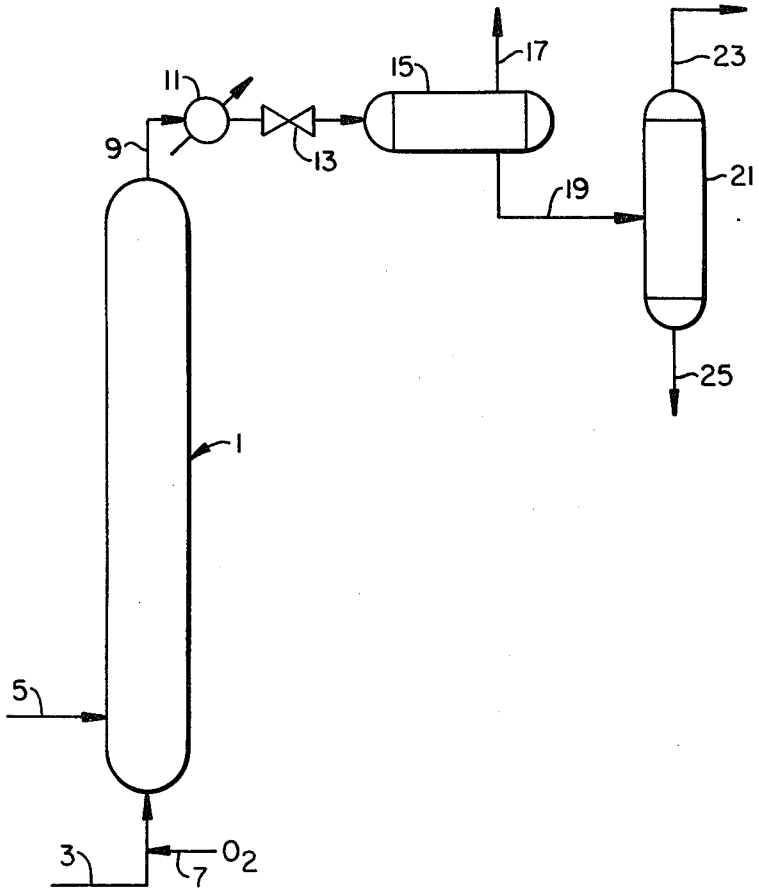
11
9
13
15
17
19
21
23
25
1
5
3
7
$O_2$

UPGRADING HYDROCARBONACEOUS OILS WITH AN AQUEOUS LIQUID

CROSS-REFERENCE TO RELATED APPLICATION

This application is a continuation-in-part of application Ser. No. 222,231, filed Jan. 2, 1981, abandoned, entitled "Upgrading Hydrocarbonaceous Oils with an Aqueous Liquid".

BACKGROUND OF THE INVENTION

The present invention concerns a process for upgrading hydrocarbonaceous oils. More specifically, the invention concerns a process for upgrading heavy oils by contacting the oils with free oxygen and liquid phase water at an elevated temperature.

Heavy petroleum fractions such as residuals and heavy crude oils can be used as low grade commercial fuels or may be converted by thermal and catalytic conversion processes into more valuable, lighter hydrocarbons, particularly gasoline. Heavy crudes and heavy oil fractions are often contaminated with substantial concentrations of detrimental materials. Common contaminants are organic nitrogen and sulfur compounds, metals, particularly nickel and vanadium, nondistillable, heat-sensitive coke precursors, such as asphatenes, and the like. When heavy oils are burned as fuel, combustion of the nitrogen and sulfur compounds results in formation of objectionable pollutants, nitrogen oxides and sulfur oxides. When heavy oils are upgraded by conventional catalytic conversions, the presence of the nitrogen and sulfur compounds, and particularly the presence of the metals, results in rapid deactivation of catalysts, and causes the upgrading of residual oils to be undesirably expensive. Conventional methods for upgrading heavy oil fractions to provide more valuable hydrocarbons often consume substantial amounts of hydrogen. The cost of hydrogen consumed is an economic drawback when hydroprocessing is employed for the upgrading. When upgrading of heavy crudes and oil fractions is carried out by means of coking, the presence of overly large concentrations of coke-forming materials, such as asphaltenes, results in lower yield of relatively more valuable distillate product and higher yield of relatively less valuable coke. Moreover, high sulfur concentration in the coke often makes it unsuitable for major applications, particularly electrode fabrication.

A general discussion of wet air oxidation technolgy, found in *Mechanical Engineering,* December 1979, page 30, is incorporated herein by specific reference. A discussion of regeneration of active carbon after use in waste water treating, by means of wet air oxidation, found in AICHE Symposium Series, Vol. 76, No. 192, (Recent Adances in Separation Technology - II), page 51 (AICHE, 1980), is incorporated herein by specific reference.

A process for removing pyritic sulfur from coal by treatment with water and air at elevated temperature and pressure to convert the pyritic sulfur to water-soluble ferrous and ferric sulfate is disclosed in U.S. Pat. No. 3,824,084. Use of silicates and an oxidizing agent (such as air, oxygen, hydrogen peroxide, alkali metal sulfides, alkaline or metal sulfides) or a reducing agent (such as $H_2$, CO, $K_2$, $S_2O_4$, $Nas_2O_4$, and alkali metal polythionates) in an aqueous medium to desulfurize coal is disclosed in U.S. Pat. No. 4,174,953 and U.S. Pat. No. 4,197,090.

Use of wet air oxidation to provide heat energy in the form of steam, as by wet oxidation of coal, is disclosed in U.S. Pat. No. 4,211,174, U.S. Pat. Nos. 4,100,730, and 4,013,560.

Use of copper or silver ions to catalyze wet air oxidation of organic material in waste water is disclosed in U.S. Pat. No. 3,912,626.

Treatment of papermill waste sludges to convert organic components to innocuous oxidation products and to provide for recovery of inorganic filter materials for reuse is disclosed in U.S. Pat. No. 3,876,497.

Essentially complete oxidation of solid or liquid combustible materials which are difficult to suspend in water, such as diesel fuel and nitroglycerine by direct injection into a wet air oxidation reactor is disclosed in U.S. Pat. No. 4,174,280.

None of the disclosures concerning wet air oxidation is concerned with upgrading of hydrocarbonaceous materials. Hydrocarbonaceous oils which are utilized in the disclosed wet air oxidation processes are simply essentially completely consumed to form highly oxidized materials, primarily carbon dioxide, water and the like.

SUMMARY OF THE INVENTION

In an embodiment, the present invention concerns a process for upgrading a hydrocarbonaceous oil which comprises contacting the oil with free oxygen in the presence of an aqueous liquid at a temperature above about 175° C. and a pressure sufficient to maintain the aqueous liquid at least partially in a liquid phase.

I have found that surprising improvements in several properties of a heavy hydrocarbonaceous oil can be advantageously obtained by contacting the oil with free oxygen and liquid phase water at an elevated temperature. The amounts of contaminants, such as metals, nitrogen and sulfur, in the oil can be substantially decreased. The viscosity of the oil can be substantially decreased. The amount of nondistillable, coke-forming constituents of the oils, such as asphaltenes, can be substantially decreased. The process of present invention also permits the viscosity of heavy oils to be substantially decreased. The present process can advantageously be performed at a temperature much lower than used in conventional heavy oil upgrading systems.

DESCRIPTION OF THE DRAWING

The attached drawing is a schematic representation of the preferred embodiment of the present invention.

Referring to the drawing, there is shown a wet air oxidation reactor 1. Aqueous liquid is introduced into the system through a conduit 3. A feed system of hydrocarbonaceous oil to be upgraded is introduced to the system through a conduit 5 and is charged to the reactor 1 through a diesel injector (not shown) at a rate of one part (by volume) of oil per four parts of aqueous liquid. Free oxygen-containing gas is introduced into the system through a conduit 7 and is mixed with the aqueous liquid in the conduit 3. The water-oxygen mixture is passed into the reactor 1. In the reactor the oil-water-oxygen mixture is maintained at suitable reaction conditions including an appropriate elevated temperature such as 204° C. and a pressure sufficient to maintain the aqueous phase as a liquid such as 50 atmospheres. The mixture flows upwardly through the reactor and is removed from the top of the reactor through a conduit 9. The mixture is then cooled in a heat exchanger 11, passed through a pressure reducing valve 13, and charged to gas separator vessel 15, in which the gases in the mixture are separated from the aqueous and hydrocarbonaceous liquids. The gases are removed from the top of the separator vessel 15 and passed out of the system through a conduit 17. The mixture of liquid aqueous and hydrocarbonaceous phases is withdrawn from the vessel 15 and passed through a conduit 19 into a phase separator, such as a settling vessel 21. The lighter oil phase rises to the top of the vessel 21 and is withdrawn from the vessel and recovered by means of a conduit 23. Aqueous liquid settles to the bottom of the vessel 21 and is withdrawn through a conduit 25. Various conventional elements necessary for carrying out the embodiment depicted in the drawing, such as control means, pumping means, compressing means and the like, are not shown or discussed. The disposition and use of such conventional elements will be apparent to those skilled in the art.

DETAILED DESCRIPTION OF THE INVENTION

A wide variety of hydrocarbonaceous oils may be upgraded by the process of this invention. In general, any oil which contains an objectionable amount of one or more undesirable contaminants can be upgraded. For example, an oil containing an undesirable concentration of one or more metalliferous contaminants can be upgraded, i.e. demetallized, by reduction of the metals concentration. Oils containing an undesirably high concentration of one or more sulfurous contaminants can be upgraded, i.e., desulfurized, by reduction of the sulfur concentration. Oils containing an undesirably high concentration of one or more nitrogenous contaminants can be upgraded, i.e., denitrified, by reduction of their nitrogen concentration. Oils having an undesirably high concentration of asphaltenes can be upgraded, i.e. deasphalted by reduction of their asphaltenes concentration. Oils having a viscosity which is higher than desired can be upgraded to decrease their viscosity by treatment according to the present invention. Oils containing an undesirably high concentration of relatively higher molecular weight hydrocarbonaceous molecules can be upgraded according to the invention to provide a product having a decreased concentration of such higher molecular weight materials and an increased concentration of lower molecular weight hydrocarbons, as by cracking and decomposition of high molecular weight heteronuclear compounds, polycylic aromatics, etc. For example, high molecular weight, nondistillable compounds, such as asphaltenes, can be converted to distillable hydrocarbon compounds and lower molecular weight compounds by upgrading according to the present invention.

Although any oil contaminated with one or more of the contaminants discussed above or having an overly high boiling range or overly high viscosity, can be suitably upgraded according to the present invention, the preferred feed oils are petroleum residuals, heavy petroleum crudes, shale oils, coal oils, tar sand oils (bitumens), and analogous natural or synthetic oils and oil fractions. For example, preferred feeds include such petroleum fractions as atmospheric distillation bottoms streams, vacuum distillation bottoms streams, catalytic cracking product fractionator bottoms and slurry oils, and in general petroleum, coal oil, tar sand oil, shale oil, or the like or heavy fractions thereof, a substantial portion of which has a normal boiling point above 565° C. Preferred heavy crude petroleum or tar sand oils for upgrading are those with one or more of the following properties: an API gravity of less than 20°; a Ramsbottom carbon residue factor of greater than 0.8; an asphaltenes (n-heptane insoluble fraction) content of greater than 3 weight percent; or a fraction of greater than 10 weight percent of the oil boiling above 565° C. Preferred feeds include bitumen derived from tar sands, i.e., bituminous sands, and heavy crudes and tars such as those found in the Athabasca region of Canada and the Orinoco region of Venezuela.

Preferred feed oils include oils having a substantial concentration of at least one metal selected from nickel and vanadium. These metals are usually present in crude oils and residual fractions in the form of organometallic compounds, such as metalloporphyrins.

Preferred feed oils include oils having a substantial concentration of finely divided solid contaminants, which may be solid organic material, solid inorganic material, or both. Examples of solids found in some preferred feed oils are clay, sand, silt and such salts as alkaline earth metal carbonates and silicates.

Preferred feed oils may be oils which are mixed with small or large concentrations of aqueous liquids. In fact, the present process provides a highly advantageous way to dispose of waste slop oils, oil-water emulsions, desalter separator cuff layers, contaminated oil bottoms from storage tanks and the like.

The aqueous liquid used in the treatment of the present invention may simply be water or may be an aqueous solution or suspension of one or more inorganic or organic compounds or ions. In some cases, addition of soluble or suspended materials can be beneficial to carrying out the process in that the added material can catalyze reactions which take place in upgrading an oil. Preferred additive materials include alkali metals, alkaline earth metals, their ions and salts. Added extraneous materials, such as alkali and alkaline earth metals, can be mixed with the feed oil or with the oxygen-containing gas prior to contacting the gas, water and oil at high temperatures, or can preferably be premixed with the aqueous phase.

The temperature at which the present process is carried out should usually be maintained above about 175° C. Preferably, the reaction temperature is maintained between about 175° C. and 300° C. Particularly preferably, the reaction temperature is maintained between about 195° C. and 260° C. The elevated operating temperature can be achieved solely by oxidation reactions which occur after the oil, water and molecular oxygen are contacted. One or more of the components can be preheated prior to contact with the other components. The mixture can also be heated by an external heat source after contact. Often, heat exchange between the hot effluent from the reaction zone and one or more of the aqueous feed, oil feed or oxygen feed is advantageous in conserving heat energy.

It will be apparent that the reaction temperatures may not be uniform over the course of the reaction time in carrying out many embodiments of the present process, since oxidation reactions will tend to increase the temperature of the reaction mixture over the extent of the contact time, if free oxygen is not limited. Thus, in a batch-type reaction, the reaction temperature may start at a very low temperature, e.g. below 175° C., and rise to a high level, e.g. above 300° C. at the end of the contact time. A similar temperature profile will often be observed when a plug flow-type contacting scheme is employed. In general, however, the reactants should be maintained within the indicated temperature ranges for at least a major portion of the total contact time. Practical contact times are usually those sufficient to allow consumption of at least a major portion of the free oxygen employed.

The pressure employed in the present process is at least sufficient to maintain at least a portion of the water, i.e., the aqueous phase, in the liquid state. Preferably, a pressure is employed which is at least sufficient to maintain the major portion of water present in the reaction mixture as a liquid. Higher pressures have the advantage of permitting relatively larger amounts of free oxygen to be dissolved or diffused in the liquid aqueous phase, but increased capital and operating costs involved in the carrying out of higher pressure operations usually set a practical upper limit on the pressure that can economically be used.

According to the invention, free oxygen, i.e., molecular or atomic oxygen, or a precursor thereof, is contacted with oil and an aqueous liquid. To supply the free oxygen component for the process, pure molecular oxygen gas ($O_2$ or $O_3$) can be used. Gases, such as air, which contain molecular oxygen mixed with one or more diluent gases, such as nitrogen, steam, carbon dioxide, etc., are also suitable for use. Solid, liquid or gaseous compounds of combined oxygen, which decompose or react to form atomic or molecular oxygen, such as hydrogen peroxide, may be used to supply the free oxygen component. The free oxygen component, or a precursor thereof, can be mixed with the aqueous liquid prior to, simultaneously with, or after contact is established between the aqueous liquid and the feed oil. The amount of free oxygen employed relative to the amount of oil should be sufficient to react with not more than a minor portion of the oil. Preferably, the free oxygen should not constitute more than about 30 weight percent of the oil.

Contact of the feed oil with aqueous liquid and with free oxygen can be carried out in a suitable conventional reactor or other suitable conventional vessel or container means, which should be sufficiently resistant to the temperatures, pressures, corrosive compounds and other reaction conditions which are encountered in carrying out the present invention. The oil, water and free oxygen components can be contacted in a batch-type system or, preferably, in a continuous type system. The oil, water and oxygen components can be contacted in cocurrent flow, in countercurrent flow, in a stirred tank-type reaction system, or in another analogous contact system. Preferably, contact is carried out in cocurrent flow through a reaction zone, particularly preferably in upflow through a vertically extending vessel. Preferably, at least a portion of the free oxygen employed is dissolved in the aqueous liquid prior to contacting the aqueous liquid with the oil to be treated.

Preferably, oil and aqueous liquid are contacted at an aqueous liquid-oil volume ratio in the range from about 0.5:1 to about 10:1. Particularly preferably, an aqueous liquid:oil volume ratio of about 1:1 to about 4:1 is used. Preferably, the feed oil is introduced into contact with the aqueous liquid in finely divided form, e.g. as droplets, as by using a mixer, diesel injector or the like.

The product oil can be separated from the water and gas by phase separation (settling, decantation, etc.) or fractional distillation or the like conventional separatation technique. The product oil can be used advantageously in several ways. One advantageous use is as a feed for a thermal distillation or coking process. Suitable conventional coking techniques include delayed coking and fluidized coking. Another advantageous use for the product oil is as a feed for a catalytic cracking operation, especially for an FCC operation in which the oil is contacted with an acidic, zeolite or non-zeolite catalyst in the absence of added molecular hydrogen. A further advantageous use for the product oil is as a feed for a hydrogen treating process such as hydrodemetalation, hydrodenitrification, hydrodesulfurization, hydrocracking or simple hydrogenation, in which the oil is contacted with a Group VIB and/or Group VIII metal on a porous carrier such as silica, alumina, clays and the like. Suitable hydrogen treating catalysts may include an acidic component such as silica-alumina, a zeolite, etc. The product oil formed in the present process can often be fractionated to provide high yields of such products as diesel fractions, jet fuels, gasolines, naphthas, etc.

As a byproduct of upgrading the feed oil, it may be advantageous to generate steam from a portion of the aqueous liquid, and the steam can be used to supply energy for electrical or mechanical power generation. It should be noted, however, that at least a portion of the aqueous phase should remain as a liquid at the end of the contacting period.

EXAMPLE

An atmospheric distillation residual oil fraction from an Arabian Heavy crude was upgraded according to the present invention in a series of bench scale tests using an upflow, vertical reactor system. The properties of the feed oil and product oils and the operating conditions used in each test are shown in the Table. In Test 2, 0.5 weight percent potassium hydroxide was dissolved in the water prior to the test. In Tests 4 and 5 hydrogen peroxide was added to the water to provide the free oxygen component by decomposition. The API gravities for the products as reported in Tests 1 and 2 in the table were calculated from a TGA analysis. Distillation figures were also calculated from TGA analyses. Feed oil was mixed with water prior to introduction of the liquids into the upflow reactor in Tests 1 and 2. In Tests 3–6, oil was sprayed into the lower end of the reactor using a diesel injector, while water was introduced along with hydrogen peroxide into the bottom of the reactor. Referring to the Table, it is apparent that upgrading an atmospheric distillation bottoms feed according to the present invention results in a substantially lighter product (higher API gravity, lower boiling range), with fewer heat-sensitive, nondistillable components such as asphaltenes (lower Ramsbottom carbon), with reduced concentration of metalliferous contaminants (Ni, V), a reduced concentration of sulfurous contaminants (weight percent S), a reduced concentration of nitrogenous contaminants (weight percent N), and a substantially decreased Saybolt viscosity. The above-noted improvements were advantageously obtained at an operating temperature much lower than used in a conventional thermal cracking system.

TABLE

| | Test No. | | | | | | |
|---|---|---|---|---|---|---|---|
| | 1 | 2 | 3 | 4 | 5 | 6 | Feed |
| Operating Conditions | | | | | | | |
| Temp., °C. | 288 | 204 | 204 | 204 | 204 | 204 | — |
| Pressure, Atm. | 71.4 | 71.4 | 55.3 | 47.6 | 47.6 | 55.3 | — |
| Oxygen, Wt. % of Oil | 17.0 | 17.4 | 16.7 | 6.3 | 11.9 | 17.0 | — |
| Water:Oil Vol. Ratio | 4:1 | 4:1 | 4:1 | 4:1 | 4:1 | 1:1 | — |
| Oil Properties | | | | | | | |
| Gravity, Degrees API | 24.3 | 25.9 | — | — | — | — | 14.0 |
| Sulfur, Wt. % | 3.4 | 3.2 | 1.6 | 2.2 | 1.2 | 1.3 | 3.4 |
| Nitrogen, Wt. % | 0.25 | 0.22 | 0.14 | 0.23 | 0.10 | 0.14 | 0.31 |
| Ramsbottom Carbon, Wt. % | 6.6 | 5.5 | 3.2 | 9.2 | 1.9 | 3.5 | 11.6 |
| Nickel, ppm (wt). | 24 | 21 | 9 | 17 | 10 | 11 | 26 |
| Vanadium, ppm (wt). | 77 | 60 | 28 | 52 | 29 | 31 | 77–80 |
| Viscosity (54° C.), SSU | 1181 | 1119 | — | 1813 | — | — | 2561 |
| Distillation | | | | | | | |
| Start | 179 | 178 | 144 | 180 | 177 | 177 | 178 |
| 5 | 341 | 298 | 180 | 358 | 288 | 291 | 597 |
| 10 | 480 | 403 | 252 | 403 | 336 | 329 | 664 |
| 30 | 789 | 763 | 422 | 529 | 427 | 415 | 849 |
| 50 | 967 | 931 | 489 | 819 | 464 | 497 | 1001 |
| 70 | 1108 | 1078 | 797 | 1030 | 659 | 730 | 1105 |
| 90 | — | — | 1157 | 1178 | 1087 | 1103 | — |
| End Point, Wt % @/°C. | 88/695 | 88/694 | 95/695 | 93/694 | 96/694 | 95/695 | 88/695 |

What is claimed is:

1. A process for upgrading a hydrocarbonaceous oil which comprises:

contacting said oil with added free oxygen in an amount not more than about 30 weight percent of said oil, in the presence of an aqueous liquid at a temperature between about 175° C., and 300° C., and at a pressure sufficient to maintain said aqueous liquid at least partially in the liquid phase.

2. A process as defined in claim 1 wherein said contacting is carried out at a temperature between 195° C. and 260° C.

3. A process as defined in claim 1 wherein said hydrocarbonaceous oil includes at least one metalliferous contaminant and said contacting decreases the concentration of said metalliferous contaminant in said oil.

4. A process as defined in claim 1 wherein said hydrocarbonaceous oil includes at least one nitrogenous contaminant and said contacting decreases the concentration of said nitrogenous contaminant in said oil.

5. A process as defined in claim 1 wherein said hydrocarbonaceous oil includes at least one sulfurous contaminant and said contacting decreases the concentration of said sulfurous contaminant in said oil.

6. A process as defined in claim 1 wherein the viscosity of said hydrocarbonaceous oil is decreased by said contacting.

7. A process as defined in claim 1 wherein said hydrocarbonaceous oil comprises hydrocarbons and the average molecular weight of hydrocarbons in said oil is decreased by said contacting.

8. A process as defined in claim 1 wherein at least one ion or salt of at least one metal selected from alkali metals and alkaline earth metals is present in said aqueous liquid during said contacting.

9. A process as defined in claim 1 wherein said hydrocarbonaceous oil, said aqueous liquid and said free oxygen are mixed together at a temperature below about 175° C. and the temperature of the resulting mixture is increased to greater than 175° C. at least in part by heat energy supplied by reaction of at least a portion of said free oxygen with a portion of said hydrocarbonaceous oil.

10. A process as defined in claim 1 wherein at least a portion of said free oxygen is dissolved in said aqueous liquid prior to contact with said hydrocarbonaceous oil.

11. A process as defined in claim 1 wherein said aqueous liquid is present during said contacting at an aqueous liquid:hydrocarbonaceous oil volume ratio of about 0.5:1 to about 10:1.

12. A process as defined in claim 1 wherein said free oxygen is formed by decomposition of hydrogen peroxide.

13. A process as defined in claim 1 wherein said hydrocarbonaceous oil is derived from oil shale.

14. A process as defined in claim 1 wherein said hydrocarbonaceous oil is derived from coal.

* * * * *

UNITED STATES PATENT AND TRADEMARK OFFICE

CERTIFICATE OF CORRECTION

PATENT NO. : 4,428,828

DATED : January 31, 1984

INVENTOR(S) : Phillip R. Bose

It is certified that error appears in the above–identified patent and that said Letters Patent are hereby corrected as shown below:

Col. 1, line 28, "asphatenes" should read --asphaltenes--.

Col. 1, line 29, "burned as fuel" should read --burned directly as fuel--.

Col. 2, line 54, "A feed system" should read --A feed stream--.

Signed and Sealed this

*Fourth* Day of *September 1984*

[SEAL]

*Attest:*

GERALD J. MOSSINGHOFF

*Attesting Officer*

*Commissioner of Patents and Trademarks*